United States Patent [19]

Vosh et al.

[11] 4,381,119

[45] Apr. 26, 1983

[54] MULTIPART CONTINUOUS FORM

[75] Inventors: Lawrence J. Vosh, Glen Falls, N.Y.; Kenneth R. D'Angelo, Ellington, Conn.

[73] Assignee: Burroughs Corporation, Detroit, Mich.

[21] Appl. No.: 217,295

[22] Filed: Dec. 17, 1980

[51] Int. Cl.[3] ..... B41L 1/20; B41L 1/32

[52] U.S. Cl. ..... 282/11.5 A

[58] Field of Search ..... 282/11.5 A, 11.5 R; 283/1 A

[56] References Cited

U.S. PATENT DOCUMENTS

| | | | |
|---|---|---|---|
| 2,352,757 | 7/1944 | Barker | 282/11.5 A |
| 3,223,437 | 12/1965 | Bertsch | 282/11.5 A |
| 3,305,247 | 2/1967 | Fulk | 282/11.5 A |
| 3,517,589 | 6/1970 | Herd et al. | 282/11.5 A X |
| 3,655,222 | 4/1972 | Wakeman | 282/11.5 A |

*Primary Examiner*—Paul A. Bell

*Attorney, Agent, or Firm*—D. G. Rasmussen; K. R. Peterson; E. M. Chung

[57] ABSTRACT

The invention is a multipart continuous form having several plies and a means to securely fasten the plies which prevents longitudinal slippage. To achieve this result the form has a series of locking and connecting tabs cut along its edge. The locking tabs fasten the inner plies of the form to the connecting tab, thereby preventing longitudinal shifting.

5 Claims, 6 Drawing Figures

MULTIPART CONTINUOUS FORM

BACKGROUND OF INVENTION

1. Field of the Invention

The invention relates to multipart continuous forms having several plies and a means to securely fasten the plies. More particularly, the invention refers to the use of connecting and locking tabs to secure the plies in a manner which allows for both flexible binding and accurate register.

2. Description of the Prior Art

It is common in the modern business world to use multipart continuous forms which contain a manifold set of plies made from continuous webs or sheets. Such forms are usually stored in zig-zag fashion; contain sprocket holes along their edge so the form can be fed through a feeding mechanism in a business machine, printer, or typewriter; and, might have perforations along one or both edges so that the forms can be easily separated. Some of the forms contain webs of carbonless paper and others use alternate layers of paper and carbon paper. The variety and style of these forms, used in modern business, are many and varied but all have one problem in common. That problem involves the longitudinal shifting of the webs relative to each other. Several attempts have been made to prevent such longitudinal shifting. One method uses lines or dots of adhesive between each ply of the form. This method provides binding which is too rigid; and, because it doesn't have sufficient flexibility, the form "tents" when run through typewriters or computer printers. Another attempted solution uses staples. This method, however, causes damage to the typewriter or printing device. Another approach suggests the use of tongues which are passed through apertures in the inner and outer plays. Although this method provides the necessary flexibility the forms separate easily and are not held together strongly enough to tolerate a bursting operation. A variation of the above method, described in U.S. Pat. No. 3,655,222, glues the tip of the tongue, which passes through the apertures of the inner ply, to the inner side of the remaining outer ply. (The upper and inner plies are made of carbonless copying sheets which can't accept adhesive on their coated exterior sides.) This method provides good flexibility and strength but the inner plies can move relative to the outer plies a distance equal to the width of the aperture hole in the inner plies. This slippage of the inner ply causes it to be out of register with the other inner plies and with both outer plies.

All of the above methods have failed to successfully couple flexible fastening with accurate longitudinal register between the plies.

SUMMARY OF THE INVENTION

The present inventors recognized the above problem and developed a form which has the needed flexibility as well as longitudinal register. Under this invention, an outer ply has a row of connecting tabs cut near its edge. A row of locking tabs are cut along the edge of each of the inner plys and placed in vertical alignment with the connecting tabs. The connecting and locking tabs are rectangular flaps which are cut from the plies and move in a hinge-like manner. The connecting and locking tabs are oriented such that the forward edge of the connecting tab faces the forward edge of the locking tab. The orientation and hinge-like nature of the locking tab enables it to open, creating a hole through which the connecting tab can be inserted, and to close, locking the connecting tab in position. The connecting tabs are passed through the inner plies in this manner and locked position. The forward edge of the connecting tab is then glued to the inner face of the remaining outer ply. As a result, the inner plies are held in close register with the two outer plies.

A novel feature is the use of connecting and locking tabs to provide a flexible fastening method for multipart continuous forms which also provides close register between the plies. Another novel feature is the use of locking tabs to fasten the inner plies to the connecting tab, thereby, preventing longitudinal shifting.

DETAILED DESCRIPTION OF THE PREFERRED EMBODIMENT

Figure 1:
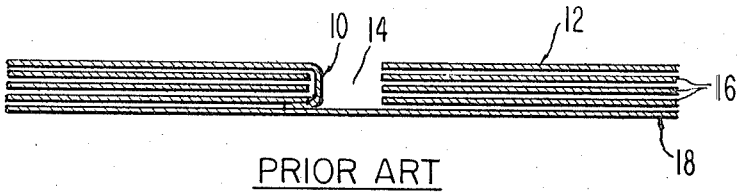
FIG. 1 is an enlarged side view of a prior art method of fastening forms.

FIG. 1 shows a representation of one of the prior art methods of form fastening. This method uses a tongue-like extension 10 cut from one of the outer plies 12 which extends through aperture 14 in the inner plies 16 and is glued to the inner side of the outer ply 18. The disadvantage of this method is that the open aperture 14 allows the inner plies 16 to move with a longitudinal motion relative to the tongue 10. This results in the form not having adequate vertical alignment between the inner and outer plies. In the invented form, the locking tab closes the aperture and locks the connecting tab to the inner ply preventing such longitudinal slippage.

Figure 2A:
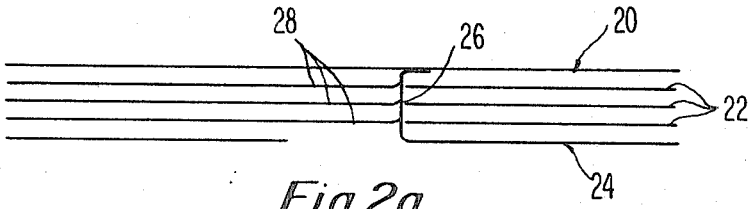
FIG. 2*a* is an enlarged side view of the multilayer continuous form, showing the connecting and locking tabs.
Figure 2B:
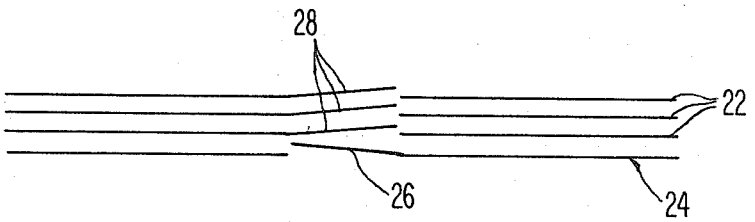
FIG. 2*b* is a side view representation of the form showing the opposite orientation of the connecting and locking tabs.
Figure 2C:
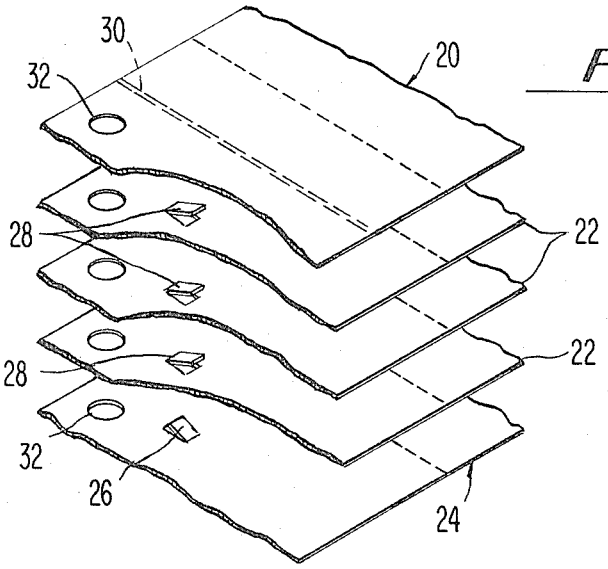
FIG. 2*c* is a perspective of a corner fragment of the multilayer continuous form.

The invented multipart continuous form is shown in FIGS. 2*a*, 2*b*, and 2*c* and is generally composed of: a first outer ply 20, a series of inner plies 22 and a second outer ply 24, all of which are in vertical alignment with the first outer ply 20. A series of connecting tabs 26 are cut along the edge of the second outer ply 24, and a series of locking tabs 28 are cut along the edge of each of the inner plies 22. As can best be seen from FIG. 2*c*, the tabs are generally rectangular flaps (although other shapes could do as well) which are cut from the plies on three connecting sides, thus, allowing them to rotate in a hinged manner around the uncut side. The connecting and locking tabs are in vertical alignment and are oriented such that the forward edge of the connecting tab 26 faces opposite to the forward edge of the locking tabs 28. The opposite orientation of the locking and connecting tabs (best illustrated in FIG. 2*b*) allows the connecting tab 26 to push up through the holes created in the inner plies 22 when the locking tabs 28 are in their open position. As shown in FIG. 2*a*, once the connecting tab 26 is pushed through the inner plies 22, the locking tabs 28 close and lock the connecting tabs 26 in position, thus, preventing longitudinal shifting. An adhesive strip 30, (shown in FIG. 2c) is made from a thin strip of glue and runs near the edge of the inner face of the first outer ply. The adhesive strip is used to fasten the connecting tab 26 to the first outer ply 20. The forms can also contain sprocket holes 32 so that they can be mechanically fed to printers and typewriters and perforated edges so the forms can be easily separated.

Figure 3:
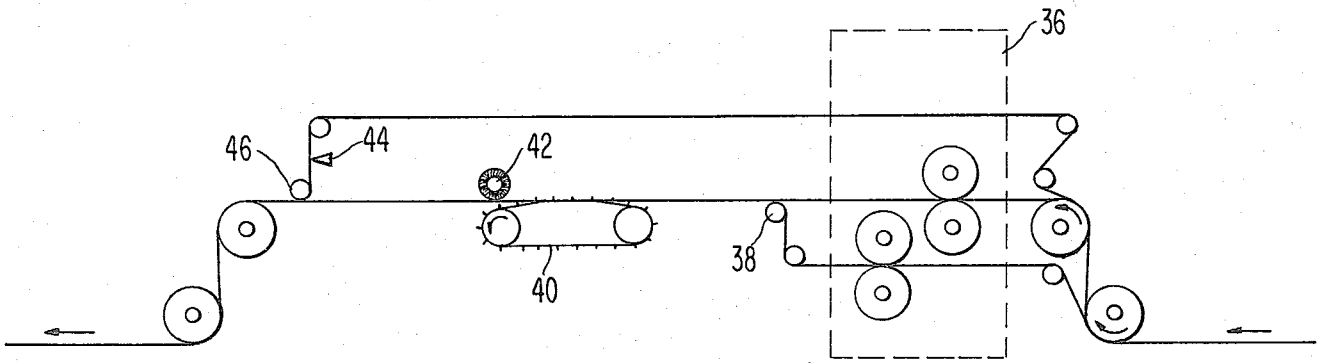
FIG. 3 is a representation of the overall process for making the invented forms.
Figure 4:
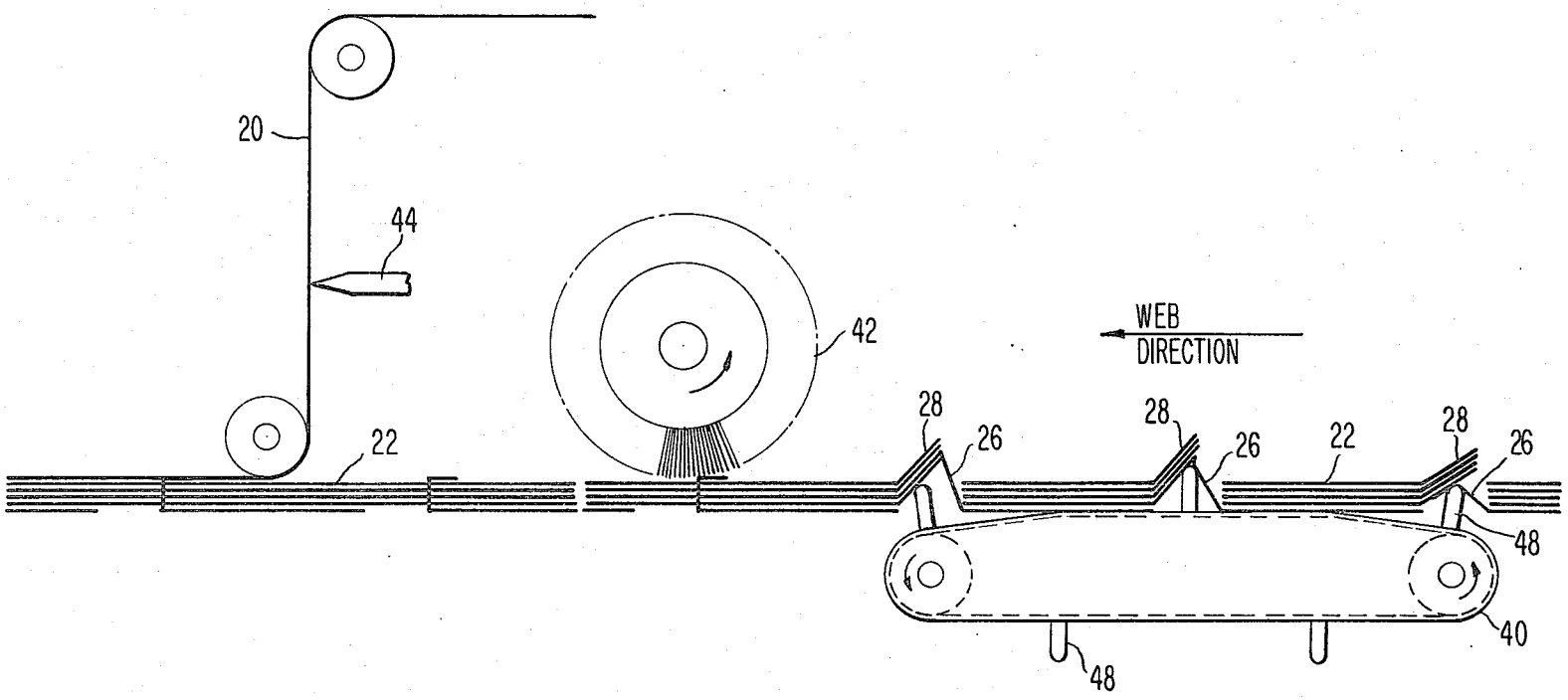
FIG. 4 is a representation showing the method of poking the connecting tab through the locking tabs and then gluing the forward end of the connecting tab to the remaining plies.

FIGS. 3 and 4 illustrate the method of making the new multipart continuous form. The overall process, illustrated in FIG. 3, starts with the punching of connecting tabs and locking tabs from the plies (step 36); the punched plies are then collated 38 so there is vertical alignment; a poking belt 40 pushes the connecting tab through the opening created by the locking tab; the forward edge of the connecting tab is then bent over by a rotating brush 42 and the locking tabs are closed; next, a thin strip of glue is applied to the inner side of the other outer ply 44 and the connecting tab is moved in contact with and glued to the remaining outer ply 46. Thus, the inner and outer plies are fastened in register with each other.

FIG. 4 is an expanded view of the poking and gluing steps used in the manufacture of the invented form. The poking belt 40 has elongated members 48 which push the connecting tab 26 through the open locking tabs 28. A rotating brush 42 closes the locking tabs 28 and bends the forward edge of the connecting tab 26 against the uppermost inner ply. The remaining outer ply 20 receives a strip of glue 44 and is pressed against the inner uppermost inner ply 22 so that the connecting tab and the outer ply are affixed together.

In operation, the invented multipart continuous form provides fastening which allows for the flexibility necessary in mechanized feeding and also eliminates the previous problem of longitudinal shifting. The locking tabs hold the inner plies securely to the connecting tabs thereby assuring vertical alignment of the inner and outer plies.

One important improvement with the invented form is the use of locking tabs which move in a hinge-like manner, opening to allow the connecting tab to penetrate through the inner plies and then closing, locking the connecting tabs in place.

Another important aspect is the placement of the locking tabs, such that the forward edge of the locking tab faces opposite the forward edge of the connecting tab. This feature enables the locking tab to swing closed in such a manner that the locking tab is held securely against the inner plies.

What is claimed is:

1. A multilayer continuous form comprising:

a first outer ply formed from a continuous web;

a plurality of inner plies consisting of continuous webs all located in vertical alignment with said first outer ply;

a second outer ply formed from a continuous web and located in vertical alignment with said inner plies and oppositely placed from said first outer ply;

a plurality of locking tabs cut near the edge of each of said inner plies, located such that said locking tabs run in a row and are in vertical alignment, and such that said locking tabs can be flapped open exposing an opening of like dimension;

an adhesive strip running along the inner side of said first outer ply and in alignment with said locking tabs; and, a plurality of connecting tabs cut near the edge of said second outer ply, being like dimensioned and vertically aligned with said locking tabs and oriented such that the forward edges of said connecting tabs point in the opposite direction to the forward edges of said locking tabs, said connecting tabs inserted through said locking tab openings, the ends of said locking tabs locking said connecting tabs in place, each said locking tab coplanar with its respective inner ply, the end of each said connecting tab being bent to be coplanar with said first outer ply and being affixed to the bottom of said first outer ply by means of said adhesive strip, assuring that said first outer ply, second outer ply, and inner plies are held in secure alignment.

2. The multilayer continuous form of claim 1 in which said adhesive strip is a narrow strip of glue.

3. The multilayer continuous form of claim 1 in which said locking tabs are rectangular flaps which are cut from said inner plies on three connecting sides so as to allow said locking tab to move in a hinge-like manner with respect to the uncut side; and, in which said connecting tabs are rectangular flaps which are cut from said second outer ply on three connecting sides so as to allow said connecting tab to move in a hinge-like manner with respect to the uncut side.

4. The multilayer continuous form of claim 1 in which said outer and inner plies can be formed from carbonless self-copying continuous webs or from continuous webs composed of a carbon paper web layer which is attached to said paper webs by a strip of glue along the edge of said carbon paper webs.

5. A multilayer continuous form comprising:

a first outer ply formed from a continuous web;

a plurality of inner plies consisting of continuous webs all located in vertical alignment with said first outer plies;

a second outer ply formed from a continuous web and located in vertical alignment with said inner plies and oppositely placed from said first outer ply;

a plurality of locking tabs which are rectangular flaps cut from said inner plies on three connecting sides so as to allow said locking tab to move in a hinge like manner with respect to the uncut side and located such that said locking tabs run in a row and are in vertical alignment and said locking tabs can be flapped open exposing an opening of like dimension;

a strip of glue running along the inner side of said outer ply and in alignment with said locking tabs; and, a plurality of connecting tabs which are rectangular flaps cut from said second outer plies on three connecting sides so as to allow each said connecting tab to move in a hinge like manner with respect to the uncut side, said connecting tabs being like dimensioned and vertically aligned with said locking tabs and oriented such that the forward edges of said connecting tabs point in the opposite direction to the forward edges of said locking tabs, said connecting tabs being inserted through said locking tab openings, the ends of said locking tabs locking said connecting tabs in place, each said locking tab coplanar with its respective inner ply, the ends of said connecting tabs being bent back to lie coplanar with said first outer ply and being affixed to the bottom of said first outer ply by means of said strip of glue, assuring that said first outer ply, second outer ply, and inner plies are held in secure alignment.

* * * * *